United States Patent [19]

Giorgi

[11] Patent Number: 4,789,309

[45] Date of Patent: Dec. 6, 1988

[54] REINFORCED INSULATED HEATER GETTER DEVICE

[75] Inventor: Ettore Giorgi, Milan, Italy

[73] Assignee: SAES Getters SpA, Milan, Italy

[21] Appl. No.: 129,304

[22] Filed: Dec. 7, 1987

[51] Int. Cl.[4] ..... F04B 37/02; C25D 13/00

[52] U.S. Cl. ..... 417/51; 313/547; 29/527.2; 204/181.5

[58] Field of Search ..... 417/48, 51; 313/547–549, 345; 445/29, 31, 41, 53, 55; 29/527.1, 527.2; 204/181.5

[56] References Cited

U.S. PATENT DOCUMENTS

| | | | |
|---|---|---|---|
| 1,292,482 | 1/1919 | Keyes | 417/48 X |
| 3,117,210 | 1/1964 | Herb | 417/51 |
| 3,221,197 | 11/1965 | Coppola | 417/51 X |
| 3,371,853 | 3/1968 | Maliakal | 417/51 X |
| 3,584,253 | 6/1971 | Wintzer | 417/51 X |
| 3,609,064 | 9/1971 | Giorgi | 417/51 |
| 3,770,601 | 11/1973 | Maan et al. | 204/181.5 X |
| 4,297,082 | 10/1981 | Wurtz et al. | 417/51 |
| 4,310,781 | 1/1982 | Steinhage et al. | 313/547 |
| 4,515,528 | 5/1985 | Young | 417/51 |

FOREIGN PATENT DOCUMENTS

| | | | |
|---|---|---|---|
| 205964 | 1/1984 | German Democratic Rep. | 417/51 |
| 22065 | 8/1979 | Japan | 204/181.5 |
| 131372 | 10/1979 | Japan | 445/29 |

*Primary Examiner*—Paul F. Neils

*Attorney, Agent, or Firm*—Quaintance & Murphy

[57] ABSTRACT

A non-evaporable getter device having an electrophoretically deposited electrically insulated heater and support lead wires. To avoid the production of loose particles or short circuits each support lead wire is encircled by a hollow insulating cylinder whose surfaces are partially covered by the electrophoretically deposited heater insulation thus providing a reinforced insulated heater getter device.

14 Claims, 3 Drawing Sheets

FIG. 4
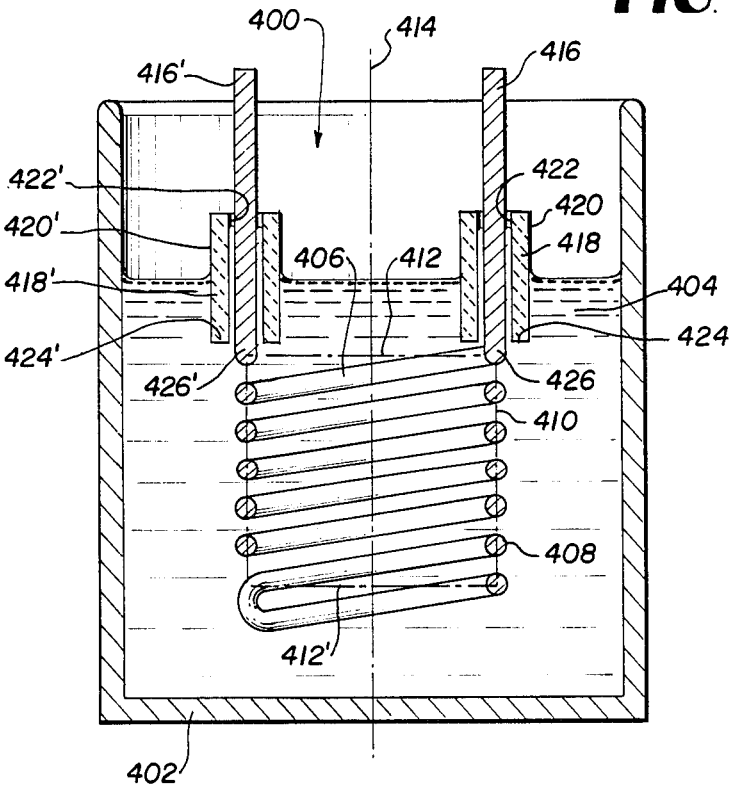
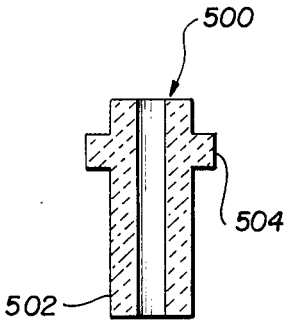
FIG. 5
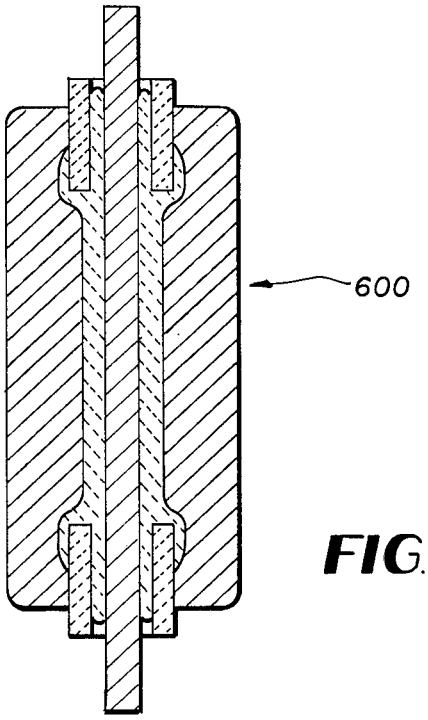
FIG. 6

REINFORCED INSULATED HEATER GETTER DEVICE

BACKGROUND TO THE INVENTION

Non-evaporable getter devices are well known in the art. One particular getter structure which has found wide acceptance by industry is described in Winzer U.S. Pat. No. 3,584,253. It comprises an insulated heating coil which is then covered with a powdered getter material. The heating coil is provided with support lead wires whose insulation extends exterior to the getter material. The insulating material is commonly a sintered layer of electrophoretically deposited alumina ($Al_2O_3$). Unfortunately this alumina is fragile and when the getter device is being handled and being assembled into a vessel (i.e., electric discharge device, vacuum vessel or rare gas filled device) where it is to be used, any bending of the support lead wires tends to cause cracking of the insulating material. This cracking also leads to the production of loose particles which can damage or impare the functioning of the device within which the getter device is used. As the cracking and detachment of insulating material is usually found to take place in the position where the support leads are exiting from the (usually metallic) getter material there may also be danger of short circuits.

BRIEF OBJECTS OF THE PRESENT INVENTION

It is therefore an object of the present invention to provide a getter device with an insulated heater which is free from one or more of the disadvantages of prior insulated heater getter devices.

It is therefore another object of the present invention to provide a getter device with an insulated heater which does not exhibit cracking of the insulating material.

It is therefore yet another object of the present invention to provide a getter device with an insulated heater which does not lead to the production of loose particles.

It is therefore a further object of the present invention to provide a getter device with an insulated heater which does not lead to the detachment of insulating material from the position where the support leads exit from the getter material.

It is therefore yet a further object of the present invention to provide a getter device with an insulated heater which is free from the danger of short circuits.

Other objects and advantages of the present invention will become apparent from the following description whereof and drawings wherein:

BRIEF DESCRIPTION OF THE DRAWINGS

FIG. 4 is a cross-sectional representation of an electrophoretic deposition bath containing a heater subassembly useful in the manufacture of a reinforced heater assembly of the present invention.

FIG. 5 is a cross sectional representation of an alternative electrically insulating cylinder useful in the present invention.

FIG. 6 is a cross sectional representation of an alternative non-evaporable getter device of the present invention.

DESCRIPTION OF THE INVENTION

Figure 1:
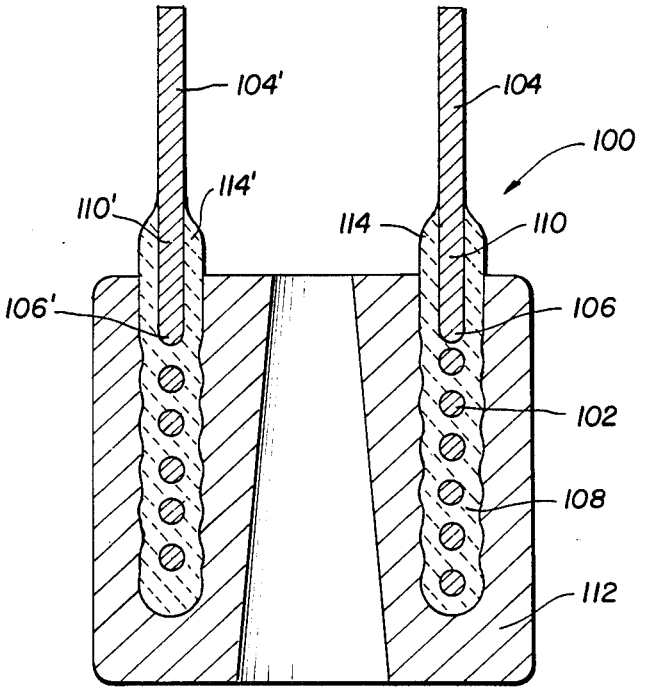
FIG.1 PRIOR ART
FIG. 1 is a cross sectional representation of a prior art getter device with an insulated heater.

In order to better understand the invention, reference will first be made to FIG. 1 which is a cross sectional representation of a prior art non-evaporable getter device 100 such as described in Winzer U.S. Pat. No. 3,584,253. Prior art getter device 100 comprises a heating wire 102 in the form of a spiral. Two support lead wires 104, 104' are integrally formed with said heating wire at positions 106, 106'. An electrophoretically deposited insulated coating 108 covers heating wire 102 and the lower portions 110, 110' of support lead wires 104, 104' in the positions 106, 106' of integral formation of the-support lead wires with the heating wire. A non-evaporable getter material 112 surrounds insulating coating 108 except for exposed portions 114, 114' of the portion of the insulating coating which surrounds support lead wires 104, 104'. Exposed portion 114, 114' provide electrical insulation between support lead wires 104, 104' and non-evaporable getter material 112 and also between support lead wires 104, 104' themselves.

It will be appreciated that any mechanical disturbance of support lead wires 104, 104' will be transmitted directly to exposed portions 114, 114' of insulating coating 108. As the electrophoretically deposited insulating coating is very fragile such mechanical disturbance will crack the insulating material leading to the production of undesirable loose particles. These particles can damage or impede the functioning of the device within which the getter device is used.

The present invention, however, provides a non-evaporable getter device which comprises a heating wire and two support lead wires which are integrally formed with the said heating wire and furthermore each support lead wire is encircled by a hollow insulating cylinder having an outer surface and inner surface whose inner diameter is greater than that of the support lead wire. One end of each insulating cylinder is in proximity with the position of integral formation of the support lead wire with the heating wire. There is also provided an electrophoretically deposited insulating coating in the form of a first zone which covers the heating wire and the second zone integrally formed with the said first zone covering part of the outer surface of each of the insulating cylinders. Furthermore there is a third zone, integrally formed with the said first zone, which extends between the diameter of the support lead wire and the inner diameter of each of the insulating cylinders. Finally there is provided a non-evaporable getter material enclosing the first and the second zones of electrophoretically deposited insulating coating and which covers part of the outer surface of the insulating cylinder.

Figure 2:
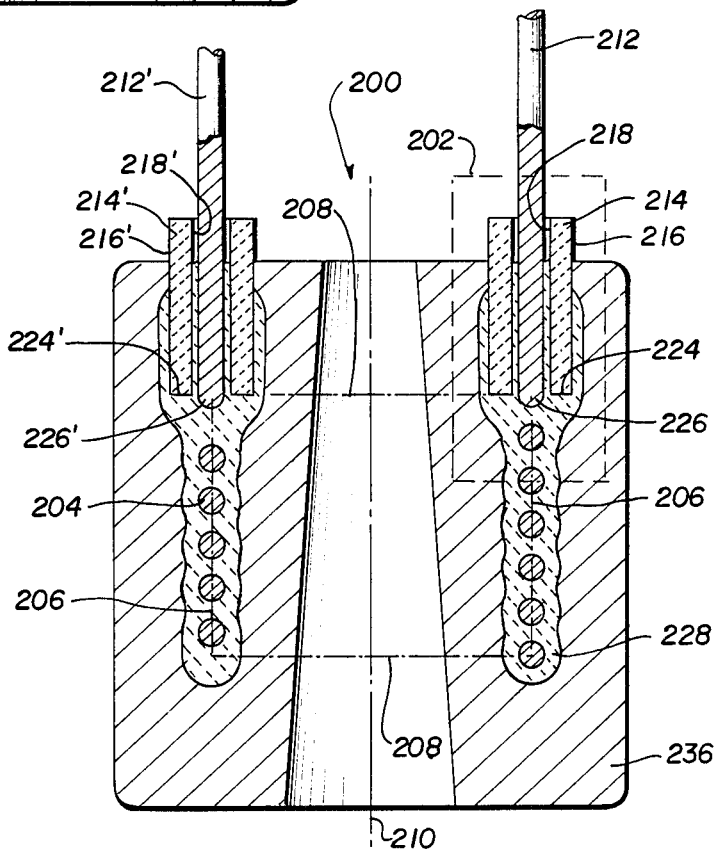
FIG. 2 is a cross sectional representation of a non-evaporable getter device of the present invention.
Figure 3:
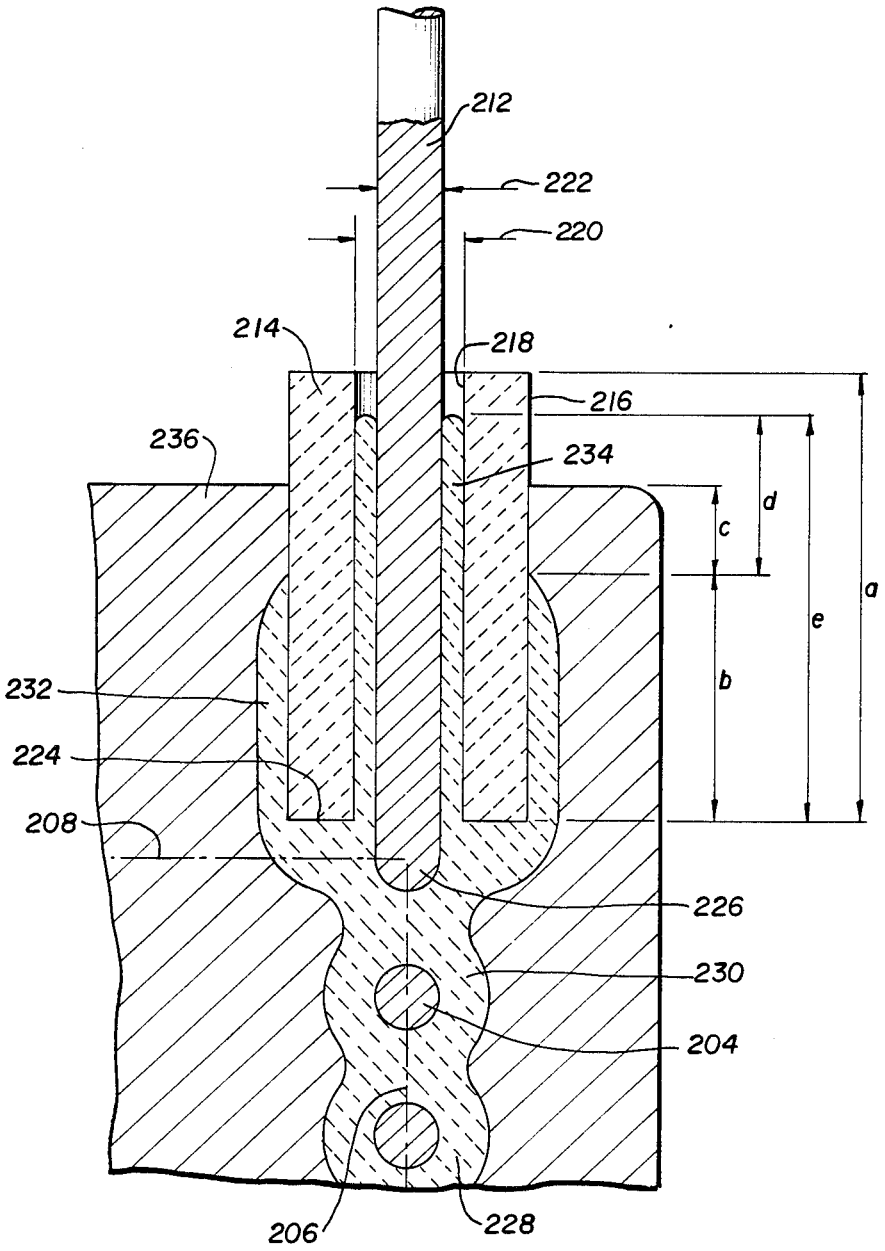
FIG. 3 is an enlarged cross sectional representation of the portion enclosed within the broken lines of FIG. 2.

Referring now in more detail to FIG. 2 there is shown a non-evaporable getter device 200 of the present invention. Reference is also made to FIG. 3 which is an enlarged view of the portion enclosed in the broken lines 202 of FIG. 2. Identical parts of FIGS. 2 and 3 are given the same detail numbers There is shown a spirally wound heating wire 204 which is of any material capable of supporting a sintering process as well as functioning as a heater on the passage of electric current. Spirally wound heating wire 204 defines a cylindrical surface 206 having two ends 208, 208'. Cylindrical surface 208 is disposed about a central axis 210. Two support lead wires 212, 212' of substantially equal length are integrally formed with said heating wire 204 and have the same diameter Each support lead 212, 212' extends from the same end 208 of the cylindrical surface 206 and are parallel to each other and to said central axis 210. Furthermore they are situated diametrically opposited to each other on cylindrical surface 206. Each support lead 212, 212' is encircled by a hollow electrically insulating $Al_2O_3$ ceramic cylinder 214, 214' respectively Each cylinder has an outer surface 216, 216' and an inner surface 218, 218'. The inner diameter 220 of inner surface 218 of ceramic cylinder 214 is from 1% to 30% and preferably from 5% to 20% greater than the diameter 222 of support lead wire 212. Similarly for inner surface 218' of ceramic 214' relative to support lead wire 212'. One end 224, 224' of each ceramic cylinder 214,214' is in proximity with the position 226, 226' of integral formation of the support lead wires 212, 212' with the heating wire 204. For convenience reference will now be made only to FIG. 3 but it will be realized that an identical description applies also to support lead wire 212' and ceramic cylinder 214' of FIG. 2. There is provided an electrophoretically deposited insulating coating 228 of $Al_2O_3$ which comprises a first zone 230 covering the spirally wound molybdenum heating wire to a thickness of between 0.03 and 0.5 mm and preferably between 0.05 and 0.2 mm. A second zone 232 of insulating coating, integrally formed with said first zone 230 covers the outer surface 216 of the ceramic cylinder to a distance of from 25% to 90% of its length and preferably from 30% to 60% of its length. A third zone 234 of insulating coating, integrally formed with said first zone also extends between the diameter 222 of lead wire 212 and the inner diameter of ceramic cylinder 214 to a distance of from 80% to 98% percent of its length and preferably from 90% to 98% of its length. Furthermore there is provided a non-evaporable getter material 236 which completely encloses the first zone 230 and the second zone 232 of electrophoretically deposited insulating coating of $Al_2O_3$. Furthermore the non-evaporable getter material 236 covers the outer surface 216 of ceramic cylinder 214 to a distance of from 10% to 80% and preferably from 20% to 60% between the distance covered by the second electrophoretically deposited zone 232 and the third electrophoretically deposited zone 234. In the broadest aspects of the invention any non-evaporable getter material can be used but it is preferably a porous non-evaporable getter material comprising;

(a) a particulate non-evaporable getter material chosen from the group consisting of titanium, zirconium and their hydrides;

(b) a particulate antisintering material chosen from the group consisting of;

(i) graphite, (ii) an alloy of zirconium with aluminium in which the weight percent of aluminium is from 5–30%;

(iii) an alloy of zirconium with $M_1$ and $M_2$ where $M_1$ is chosen from the group consisting of vanadium or niobium and $M_2$ is chosen from the group consisting of iron and nickel;

(iv) an alloy of Zr-V-Fe whose composition in weight percent, when plotted on a ternary composition diagram in weight percent Zr, weight percent V and weight percent Fe, lies within a polygon having as its corners the points defined by:

—75% Zr—20% V—5% Fe

—45% Zr—20% V—35% Fe

—45% Zr—50% V—5% Fe.

The following Table I shows the various preferred relationships between the lengths of the ceramic cylinder which are covered by the various components.

TABLE I

| Length shown on FIG. 3 | Preferred | Most Preferred |
|---|---|---|
| "b", distance of outer surface 216 covered by second zone 232 | 25% a–90% a | 30% a–60% a |
| "c", distance of outer surface 216 covered by non-evaporable getter material between distances covered by 2nd and 3rd zones | 10%–80% | 20%–60% |
| "e", distance of inner surface 218 covered by zone 3 | 80% a–98% a | 90% a–98% a |

(Note: 'a' is the basic length of the ceramic cylinder)

FIG. 4 shows an apparatus 400 useful in a method for the manufacture of a non-evaporable getter device of the present invention. Apparatus 400 comprises a tank 402 holding a bath of coating suspension 404 adapted for the electrophoretic coating of $Al_2O_3$. The bath of coating suspension comprises from 1250 to 1750 grams of alumina type A (38–900) and more preferably from 1400 to 1600 grams. The bath also contains from 750 to 1250 grams and preferably of from 900 grams to 1100 of alumina type DYNAMIT. There is also added from 25 to 75 grams and preferably from 40 grams to 60 grams of dry magnesium nitrate. There is added from 1600 to 2000 cm and preferably from 1700 to 1900 $cm^3$ of 95% ethyl alcohol together with from 1000 $cm^3$ to 1500 $cm^3$ and preferably from 1150 to 1350 $cm^3$ of distilled water. Finally there is added from 115 to 155 cm and preferably from 125 to 145 $cm^3$ of "wet binder". The wet binder may be suitably prepared by dissolving aluminium turnings in a solution of aluminium nitrate according to methods well known in the art. A heater sub-assembly 406 is prepared by taking a spirally wound molybdenum heating wire 408 which defines a cylindrical surfaces 410 having two ends 412, 412' the cylindrical surface 410 being disposed about a central axis 414. Furthermore two support wires 416, 416' of substantially equal length are integrally formed with said heating wire 408 and having the same diameter extend from end 412 of the cylindrical surface in a direction parallel to said central axis and being situated diametrically opposite to each other. Each support lead is encircled by a hollow electrically insulating $Al_2O_3$ ceramic cylinder 418, 418'. The ceramic cylinder outer surfaces 420, 420' respectively and inner surfaces 422, 422' whose inner diameter is from 1% to 30% and preferably from 5% to 20% greater than that of the support lead wires 416, 416'. One end 424, 424' of ceramic cylinders 418, 418' is in proximity with the position 426, 426' of integral formation of the support lead wires with the heating wire.

The dimensions of a heater sub-assembly thus manufactured is given in Table II below.

TABLE II

| DETAIL | DIMENSIONS |
|---|---|
| Height of cylindrical surface 410 (heater spiral height) | 9 mm |
| Support lead wire 416, 416' length | 8 mm |
| Support lead wire 416, 416' diameter | 0.55 mm |
| Ceramic cylinder 214, 214' length | 4.0 mm |

TABLE II-continued

| DETAIL | DIMENSIONS |
|---|---|
| Ceramic cylinder 214, 214' outer diameter | 1.00 mm |
| Ceramic cylinder 214, 214' inner diameter | 0.60 mm |
| (Cylinder inner diameter/wire diameter) × 100 | 9.1% |

Heater sub-assembly 406 is then placed in an apparatus 400 containing coating suspension 404 to a depth such that the coating suspension covers the heating wire and covers each of the ceramic cylinders to a distance of from 25% to 90% of its length and preferably from 30% to 60% of its length and which also enters the volume contained between the diameter of the support lead wire and the inner diameter of each of the cylinders to a distance of from 90% to 98% of its length.

A D. C. voltage of 75 Volts is then applied between the heating wire and a circular electrode (not shown) surrounding sub-assembly 406 for a period of 30 seconds to electrophoretically deposit an insulating coating of $Al_2O_3$ thus producing a first zone covering spirally would molybdenum heating wire 408 to a thickness of between 0.05 and 0.3 mm and a second zone integrally formed with the first zone covering the outer surface of each ceramic cylinder to a distance of from 30% to 60% of its length and a third zone integrally formed with the said first zone extending between the diameter of the lead wire and the outer and the inner diameter of each ceramic cylinder to a distance of from 90% to 98% of its length thus producing a reinforced heater assembly. Table III below shows the dimensions of a reinforced heater assembly produced.

TABLE III

| DETAIL | DIMENSION | As % of "a" |
|---|---|---|
| Electrophoretic coating thickness on spiral heater wire | 0.20 mm | — |
| "b" | 1.5 mm | 37.5% |
| "e" | 3.8 mm | 92.5% |

The reinforced heater assembly is then sintered in a hydrogen furnace at a temperature of from 1600° to 1700° C. for a time of from 3' to 10' to produce a sintered reeinforced heater assembly. The sintered reinforced heater assembly is then coated with a non-evaporable getter material according to any technique well-known in the art. The non-evaporable getter material is preferably porous and comprises;

(a) a particulate non-evaporable getter material chosen from the group consisting of titanium, zirconium and their hydrides;

(b) a particulate antisintering material chosen from the group consisting of:

(i) graphite, (ii) an alloy of zirconium with aluminium in which the weight percent of aluminium is from 5–30%;

(iii) an alloy of zirconium with $M_1$ and $M_2$ where $M_1$ is chosen from the group consisting of vanadium or niobium and $M_2$ is chosen from the group consisting of iron and nickel;

(iv) an alloy of Zr-V-Fe whose composition in weight percent, when plotted on a ternary composition diagram in weight percent Zr, weight percent V and weight percent Fe, lies within a polygon having as its corners the points defined by:

—55% Zr—20% V—5% Fe

—45% Zr—20% V—35% Fe

—45% Zr—50% V—5% Fe.

The non-evaporable getter material completely encloses the first and second zones of electrophoretically deposited insulating coating of $Al_2O_3$ and covering the outer surface of each ceramic cylinder to a distance midway between the distance covered by a second electrophoretically deposited zone and the third electrophoretically deposited zone.

It will be realized that the $Al_2O_3$ ceramic cylinders may have various forms for instance: FIG. 5 shows an alternative A cylinder in which the cylindrical portion 502 is provided with an additional cylindrical wing portion 504. Those skilled in the art will be able to realize alternative modifications which are intended to fall within the scope of the present invention. For instance the external surface may be provided with vertical grooves or spiral grooves either extending into the cylindrical surface or protruding from the cylindrical surface. The cylindrical portion 504 may be a single cylindrical Portion or may be a multitude of wing portions provided at different distances along the cylinder length.

FIG. 6 shows a cross-sectional representation of an alternative non-evaporable getter device 600 of the present invention which is identical in all respect to the getter device of FIG. 2 except that the heater has a linear form instead of a spiral form.

Although the invention has been described in considerable detail with reference to certain preferred embodiments designed to teach those skilled in the art how best to practice the invention, it will be realized that other modifications may be employed without departing from the spirit and scope of the appended claims.

What is claimed is;

1. A non-evaporable getter device comprising;

A. a heating wire and;

B. two support lead wires, integrally formed with said heating wire, and;

C. each support lead wire encircled by a hollow insulating cylinder, having an outer surface and an inner surface whose inner diameter is greater than that of the support lead wire, one end of each insulating cylinder in proximity with the position of integral formation of the support lead wire with the heating wire and;

D. an electrophoretically deposited insulating coating comprising;

(a) a first zone covering the heating wire and;

(b) a second zone, integrally formed with said first zone, covering part of the outer surface of each insulating cylinder and;

(c) a third zone, integrally formed with said first zone, extending between the diameter of the support lead wire and the inner diameter of each insulating cylinder and;

E. a non-evaporable getter material enclosing the first and second zones of electrophoretically deposited insulating coating and covering part of the outer surface of the insulating cylinder.

2. A getter device of claim 1 in which the inner diameter of the insulating cylinder is from 1% to 30% greater than the diameter of the support lead wire.

3. A getter device of claim 1 in which the inner diameter of the insulating cylinder is from 5% to 20% greater than the diameter of the support lead wire.

4. A non-evaporable getter device of claim 1 in which the first zone of electrophoretically deposited insulating coating has a thickness of between 0.03 and 0.5 mm.

5. A non-evaporable getter device of claim 1 in which the second zone of electrophoretically deposited insulating coating covers the outer surface of each insulating cylinder to a distance of from 25% to 90% of its length.

6. A non-evaporable getter device of claim 1 in which the third zone of electrophoretically deposited insulating coating extends between the diameter of the lead wire and the inner diameter of each ceramic cylinder to a distance of from 80% to 98% of its length.

7. A porous non-evaporable getter device comprising;

A. a spirally wound molybdenum heating wire defining a cylindrical surface having two ends, the cylindrical surface being disposed about a central axis and;

B. two support lead wires of substantially equal length, integrally formed with said heating wire and of the same diameter, extending from the same end of the cylindrical surface and parallel to said central axis, situated diametrically opposite to each other and;

C. each support lead encircled by a hollow electrically insulating $Al_2O_3$ ceramic cylinder, having an outer surface and an inner surface whose inner diameter is from 5% to 20% greater than that of the support lead wire, one end of each ceramic cylinder in proximity with the position of integral formation of the support lead wire with the heating wire and;

D. an electrophoretically deposited insulating coating of $Al_2O_3$ comprising;

(a) a first zone covering the spirally wound molybdenum heating wire to a thickness of between 0.05 and 0.2 mm and;

(b) a second zone, integrally formed with said first zone, covering the outer surface of each ceramic cylinder to a distance of from 30% to 60% of its length and;

(c) a third zone, integrally formed with said first zone, extending between the diameter of the lead wire and the inner diameter of each ceramic cylinder to a distance of from 90% to 98% of its length and;

E. a non-evaporable getter material comprising;

(a) a particulate non-evaporable getter material chosen from the group consisting of titanium, zirconium and their hydrides;

(b) a particulate antisintering material chosen from the group consisting of:

(i) graphite, (ii) an alloy of zirconium with aluminium in which the weight percent of aluminium is from 5–30%;

(iii) an alloy of zirconium with $M_1$ and $M_2$ where $M_1$ is chosen from the group consisting of vanadium or niobium and $M_2$ is chosen from the group consisting of iron and nickel;

(iv) an alloy of Zr-V-Fe whose composition in weight percent, when plotted on a ternary composition diagram in weight percent Zr, weight percent V and weight percent Fe, lies within a polygon having as its corners the points defined by:

—75% Zr—20% V—5% Fe

—45% Zr—20% V—35% Fe

—45% Zr—50% V—5% Fe;

the non-evaporable getter material completely enclosing the first and second zones of electrophoretically deposited insulating coating of $Al_2O_3$ and covering the outer surface of each ceramic cylinder to a distance of from 20% to 60% between the distance covered by the second electrophoretically deposited zone and the third electrophoretically deposted zone.

8. A method for the manufacture of a non-evaporable getter device comprising the steps of;

I. placing a heater sub-assembly in a bath of coating suspension adapted for the electrophoretic deposition of an insulating coating, said heater sub-assembly comprising A. a heating wire and;

B. two support lead wires, integrally formed with said heating wire and;

C. each support lead encircled by a hollow insulating cylinder, having an outer surface and an inner surface whose inner diameter is greater than that of the support lead wire, one end of each ceramic cylinder in proximity with the position of integral formation of the support lead wire with the heating wire, to a depth such that the coating suspension, a. covers the heating wire, and b. covers part of the outer surface of each ceramic cylinder, and c. enters the volume contained between the diameter of the support lead wire and the inner diameter of each ceramic cylinder, then II. electrophoretically depositing an insulating coating to produce:

(a) a first zone covering the heating wire and;

(b) a second zone, integrally formed with said first zone, covering part of the outer surface of each insulating cylinder and;

(c) a third zone, integrally formed with said first zone, extending between the diameter of the lead wire and the inner diameter of each insulating cylinder thus producing a reinforced heater assembly, then, III. sintering the reinforced heater assembly to produce a sintered reinforced heater assembly then, IV. coating the sintered reinforced heater with a non-evaporable getter material, the non-evaporable getter material enclosing the first and second zones of electrophoretically deposited insulating coating and covering part of the outer surface of each insulating cylinder.

9. A method of manufacturing a non-evaporable getter device of claim 8 in which the inner diameter of the insulating cylinder is from 1% to 30% greater than the diameter of the support lead wire.

10. A method of manufacturing a non-evaporable getter device of claim 8 in which the inner diameter of the insulating cylinder is from 5% to 20% greater than the diameter of the support lead wire.

11. A method of manufacturing a non-evaporable getter device of claim 8 in which the first zone of electrophoretically deposited insulating coating is deposited to a thickness of between 0.03 and 0.5 mm.

12. A method of manufacturing a non-evaporable getter device of claim 8 in which the second zone of electrophoretically deposited insulating coating is deposited on the outer surface of each insulating cylinder to a distance of from 25% to 90% of its length.

13. A method of manufacturing a non-evaporable getter device of claim 8 in which the third zone of electrophoretically deposited insulating coating is deposited between the diameter of the lead wire and the inner diameter of each ceramic cylinder to a distance of from 80% to 98% of its length.

14. A method for the manufacture of a porous non-evaporable getter device comprising the steps of;

I. placing a heater sub-assembly in a bath of coating suspension adapted for the electrophoretic coating of $Al_2O_3$, said heater sub-assembly comprising;

A. a spirally wound molybdenum heating wire defining a cylindrical surface having two ends, the cylindrical surface being disposed about a central axis and;

B. two support lead wires of substantially equal length, integrally formed with said heating wire and of the same diameter, extending from the same end of the cylindrical surface and parallel to said central axis, situated diametrically opposited to each other and;

C. each support lead encircled by a hollow electrically insulating $Al_2O_3$ ceramic cylinder, having an outer surface and an inner surface whose inner diameter is from 5% to 20% greater than that of the support lead wire, one end of each ceramic cylinder in proximity with the position of integral formation of the support lead wire with the heating wire, to a depth such that the coating suspension, a. covers the heating wire, and b. covers each ceramic cylinder to a distance of from 30% to 60% of its length, and c. enters the volume contained between the diameter of the support lead wire and the inner diameter of each ceramic cylinder to a distance of from 90% to 98% of its length, then II. electrophoretically depositing an insulating coating of $Al_2O_3$ to produce:

(a) a first zone covering the spirally wound molybdenum heating wire to a thickness of between 0.05 and 0.2 mm and;

(b) a second zone, integrally formed with said first zone, covering the outer surface of each ceramic cylinder to a distance of from 30% to 60% of its length and;

(c) a third zone, integrally formed with said first zone, extending between the diameter of the lead wire and the inner diameter of each ceramic cylinder to a distance of from 90% to 98% of its length, thus producing a reinforced heater assembly, then, III. sintering the reinforced heater assembly in a hydrogen furnace at a temperature of from 1600° to 1700° C. for a time of from 3 to 10 minutes to produce a sintered reinforced heater assembly then, IV. coating the sintered reinforced heater with a non-evaporable getter material comprising;

(a) a particulate non-evaporable getter material chosen from the group consisting of titanium, zirconium and their hydrides;

(b) a particulate antisintering material chosen from the group consisting of:

(i) graphite, (ii) an alloy of zirconium with aluminium in which the weight percent of aluminium is from 5–30%;

(iii) an alloy of zirconium with $M_1$ and $M_2$ where $M_1$ is chosen from the group consisting of vanadium or niobium and $M_2$ is chosen from the group consisting of iron and nickel;

(iv) an alloy of Zr-V-Fe whose composition in weight percent, when plotted on a ternary composition diagram in weight percent Zr, weight percent V and weight percent Fe, lies within a polygon having as its corners the points defined by:

—75% Zr—20% V—5% Fe
—45% Zr—20% V—35% Fe
—45% Zr—50% V—5% Fe the non-evaporable getter material completely enclosing the first and second zones of electrophoretically deposited insulating coating of $Al_2O_3$ and covering the outer surface of each ceramic cylinder to a distance of from 20% to 60% between the distance covered by a second electrophoretically deposited zone and the third electrophoretically deposited zone.

* * * * *